US007311434B2

(12) United States Patent
Pryor

(10) Patent No.: US 7,311,434 B2
(45) Date of Patent: Dec. 25, 2007

(54) MOVABLE LIGHTING APPARATUS

(76) Inventor: Jae Won Kim Pryor, 382 Central park W. #12R, New York, NY (US) 10025

( * ) Notice: Subject to any disclaimer, the term of this patent is extended or adjusted under 35 U.S.C. 154(b) by 0 days.

(21) Appl. No.: 11/677,170

(22) Filed: Feb. 21, 2007

(65) Prior Publication Data

US 2007/0133207 A1 Jun. 14, 2007

Related U.S. Application Data

(63) Continuation-in-part of application No. 11/292,814, filed on Dec. 2, 2005, now abandoned.

(60) Provisional application No. 60/632,593, filed on Dec. 2, 2004, provisional application No. 60/691,226, filed on Jun. 16, 2005.

(51) Int. Cl.
*F21V 21/34* (2006.01)

(52) U.S. Cl. ..... 362/648; 362/404; 362/147; 439/110

(58) Field of Classification Search ..... 362/147, 362/404, 430, 648, 647; 439/110, 116
See application file for complete search history.

(56) References Cited

U.S. PATENT DOCUMENTS 2,905,806 A * 9/1959 Tunney ..... 362/459
5,833,358 A * 11/1998 Patik ..... 362/391
6,540,372 B2 * 4/2003 Joseph ..... 362/147

* cited by examiner

*Primary Examiner*—Laura Tso

(57) ABSTRACT

A movable lighting apparatus includes first and second slide bars to which negative and positive electric power is respectively applied, sliders which move perpendicularly with the first and second slide bars, respectively and receive electric power of a corresponding slide bar, respectively, third and fourth slide bars which are connected between the sliders, and an illumination/connection power connector which supplies the movable lighting apparatus with electric power via the third and fourth slide bars and which is movable along the third and fourth slide bars to thus provide movable lighting illumination.

25 Claims, 19 Drawing Sheets

MOVABLE LIGHTING APPARATUS

CROSS-REFERENCE TO RELATED PATENT APPLICATION

This application is a continuation-in-part application of U.S. application Ser. No. 11/292,814 filed Dec. 2, 2005 now abandoned, which is a nonprovisional application of and claims the benefit of, U.S. Provisional Application Ser. No. 60/632,593 filed on Dec. 2, 2004 and U.S. Provisional Application Ser. No. 60/691,226 filed on Jun. 16, 2005, the contents of which are incorporated herein in their entirety by reference.

BACKGROUND OF THE INVENTION

1. Field of the Invention

The present invention relates to a movable lighting system, and more particularly, to a movable lighting apparatus for use in an aerial or ceiling lighting system of which the position of the movable lighting apparatus is conveniently set along X-axis and Y-axis rails to which electric power polarities are respectively separately supplied and electric power is applied to the movable lighting apparatus via an illumination/connection power connector from the X-axis and Y-axis rails, to thereby move in the width and length directions on a ceiling plane to illuminate a desired place, in which fallouts are blocked from the upward and the minimum power supply lines are secured.

2. Description of the Related Art

In the case of a conventional temporary lighting system which is installed at a sales promotion product display booth or exhibit hall in view of the publicity, electric sheathed cables are laid over in a temporary building formed of a basic framework and socket outlets are connected with the terminating ends of the cables, respectively, so as to be connected with needed lighting apparatuses.

Moreover, where a ceiling is secured in a building or pavilion, an illumination facility may be provided for a special purpose or a stage may be decorated. A temporary performance place equipped with both a stage and an illumination facility may be also prepared for. Moreover, the illumination location may be frequently changed according to an exhibit item, even with the existing illumination facilities. In these cases, the wiring facilities for the lighting fixtures should be changed or modified.

The change or modification of the wiring facilities may cause generation of many power lines. For the connection or wiring of the changed or modified power lines, convenience socket outlets, plugs, and lamps should be changed or modified. In conclusion, the change or modification of the wiring facilities may cause an increase in time for preparation of the complicated power lines. The maintenance cost may increase due to the frequent change or modification of the wiring facilities when a building is used as a long-term pavilion. The risk of the fire may increase due to the complexity of the unarranged power lines. It is very troublesome to install a concentrated illumination to be desired. In this case, it is troublesome that a support for the concentrated illumination should be necessarily installed separately from the power lines.

In addition, an efficient illumination facility is required for in order to meet the frequent change of the illumination location in view of the exhibition purpose even with the general lighting equipment.

Moreover, in the case of the conventional movable lighting system, lighting apparatuses can be only moved to respective desired positions, but the separate electric wiring cables should be provided to the lighting apparatuses. Accordingly, considering movement of the lighting apparatuses, a more considerably additional length of cables is installed. Since the cables are hang down near the places close to the power supply, the surplus cables hamper or become a disturbance in taking the photograph.

SUMMARY OF THE INVENTION

To solve the above problems of the conventional art, it is an object of the present invention to provide a newly proposed movable lighting apparatus which improves a conventional complicated illumination facility which is temporary, whose illumination location is frequently changed, and which requires for separate supports for supporting an electric power supply and lighting apparatuses.

It is another object of the present invention to provide a ceiling movable lighting apparatus in which the falling/contact of conductivity fallouts is prevented from the ceiling.

It is still another object of the present invention to provide a movable lighting apparatus which can be used in a temporary publicity display booth or exhibit hall requiring various kinds of illuminating fixtures.

It is yet another object of the present invention to provide a movable lighting apparatus which is appropriate for an illumination facility in which a number of illumination lamps can be freely moved and illumination location can be frequently changed.

It is yet still another object of the present invention to provide a movable lighting apparatus which is equipped with a fallout prevention unit for preventing conductive fallout from falling and is appropriate for places where an illumination facility is temporarily used in the short term and illumination location is frequently changed, including a power supply unit in which negative and positive electric power lines are separated, exposed, firm, and appropriate for performing a sliding function.

It is a further object of the present invention to provide a movable lighting apparatus which is equipped with a fallout prevention unit for preventing conductive fallout from falling and is appropriate for places where an illumination facility is temporarily used in the short term and illumination location is frequently changed, including a power supply unit in which negative and positive electric power lines are separated, exposed, firm, and appropriate for performing a sliding function, and third and fourth slide bars in which the two slide bars are exposed, electrified by contact of the two slide bars, and enable a sliding movement.

It is a still further object of the present invention to provide a movable lighting apparatus which is equipped with a fallout prevention unit for preventing conductive fallout from falling and is appropriate for places where an illumination facility is temporarily used in the short term and illumination location is frequently changed, including a power supply unit in which negative and positive electric power lines are separated, exposed, firm, and appropriate for performing a sliding function, and third and fourth slide bars in which the two slide bars are exposed, electrified by contact of the two slide bars, and enable a sliding movement, wherein the movable lighting apparatus can move between the two slide bars for electrification and for supporting the movable lighting apparatus.

It is a yet further object of the present invention to provide a movable lighting apparatus which does not have any separate electric wiring cables, does not hamper with the wiring cables, and is simply installed since an illumination fixture receives electric power directly from rails to then be turned on.

It is a yet still further object of the present invention to provide a movable lighting apparatus which is provided with a connection power connector which is elastically supported at both sides of a movable unit which is inserted into rails to then be slided, so as to elastically contact power supply terminals while maintaining a contact state between the connection power connector and the power supply terminals, during moving.

It is a further object of the present invention to provide a movable lighting apparatus which is equipped with movable wheels at respective edges of a movable unit so that the movable lighting apparatus can be smoothly slided along rails.

It is a further object of the present invention to provide a movable lighting apparatus which includes a roller which is formed at the leading end of a connection power connector, so that the roller can rotate on power supply terminals to thereby minimize a contact friction, and in particular, includes a number of rollers to thus stabilize a contact state between the connection power connector and the power supply terminals.

To accomplish the above object of the present invention, there is provided a movable lighting apparatus comprising:

first and second slide bars to which electric power of predetermined polarities is respectively applied;

sliders which move along the first and second slide bars, respectively and contact and receive electric power of a corresponding slide bar, respectively;

third and fourth slide bars which are connected between the sliders; and an illumination/connection power connector which supplies the movable lighting apparatus with electric power via the third and fourth slide bars and which is movable along the third and fourth slide bars to thus provide movable lighting illumination.

Preferably, the first and second slide bars are connected perpendicularly with wiring frames having built-in power lines.

Preferably, the movable lighting apparatus further comprises a main power connector comprising: the left and right wiring frames; upper and lower bodies which are formed of non-conductive grooves between the first and second slide bars and in which the bare wires which are withdrawn from the wiring frames are exposed; and fixing bolts.

Preferably, the illumination/connection power connector further comprises an illumination socket to which predetermined power lines are withdrawn via the slide bars.

Preferably, the illumination/connection power connector comprises: a body at both upper sides of which a catching portion is formed and whose lower portion is connected in a plate form; conductive contact plates formed in the inner sides of both the catching portions, respectively; a suspended member having built-in power lines withdrawn from the contact plate; and a socket adhered to the suspended member.

Preferably, the slider comprises: an insulation body in which a throughhole is formed so that the first and second slide bars are penetrated through the throughhole, respectively, conductive bearings are formed in the inner side of the insulation body, and throughholes are formed through which the third and fourth slide bars are penetrated, wherein the third and fourth slide bars are fixed through the throughholes through which the third and fourth slide bars are penetrated as conductive bolts and the electric power of the first and second slide bars is applied to the third and fourth slide bars via the conductive bearings and the conductive bolts.

Preferably, the slider comprises: a metal body in which a throughhole is formed so that the first and second slide bars are penetrated through the throughhole, respectively, conductive bearings are formed in the inner side of the metal body, and other throughholes are formed through which the third and fourth slide bars are penetrated, wherein an insulation sleeve is penetrated and inserted through one of the throughholes through which the third and fourth slide bars are penetrated, and the electric power of the first and second slide bars is applied to only one of the third and fourth slide bars having no insulation sleeve via the conductive bearings.

There is also provided a movable lighting apparatus comprising:

a pair of fixed rails having bar-shaped terminals to which negative and positive electric power voltages are applied in both sides of a fixed rail frame, respectively, and which are disposed on the ceiling in parallel with each other;

at least one movable rail having bar-shaped terminals in both sides of a movable rail frame and which is cross-linked perpendicularly with the fixed rails via fixing frames which are combined with both ends of the movable rail, respectively;

an illumination/connection power connector including a socket and a lamp coupled with the socket, and which is disposed below the movable rail; and a movable unit including movable wheels which are attached to respective edges of a body, wherein the mobile unit is fixed to the fixing frames of the movable rails and the upper end of the illumination/connection power connector, respectively, so as to be inserted into the inner sides, and electrified with the main power connector, the movable rails, and the socket of the illumination/connection power connector via the electric wires penetrated through the body, respectively.

Preferably, the main power connector comprises an elastic member; a housing which is supported by the elastic member, and a roller idling at the leading end of the housing.

Preferably, the housing comprises a guide pin which is formed at the rear end of the housing, for guiding the location of the elastic member.

Preferably, the body comprises accommodation grooves through which the main power connector is inserted at both the sides of the body, and inclined pieces formed in both the inner walls of the accommodation grooves, and the movable unit comprises elongate holes through which the inclined pieces of the body are inserted at both the sides of the housing in the main power connector.

Preferably, the main power connector comprises an elastic member; a housing which is supported by the elastic member, and a contact piece fixed at the leading end of the housing, and slidably contacting the electric power terminals.

Preferably, the fixed rail comprises an electric power supply plug, and a cover which is connected with the electric power supply plug and provides connection ends connected with the power supply terminals, and which is inserted into the end of the frame.

Preferably, the illumination/connection power connector further comprises a connection tube which connects the illumination/connection power connector at the lower end of the movable unit which can slide along the movable rails.

BRIEF DESCRIPTION OF THE DRAWINGS

The above and other objects and advantages of the present invention will become more apparent by describing the preferred embodiment thereof in more detail with reference to the accompanying drawings in which.

DETAILED DESCRIPTION OF THE INVENTION

A movable lighting apparatus according to preferred embodiments of the present invention will be described with reference to the accompanying drawings.

Figure 1:
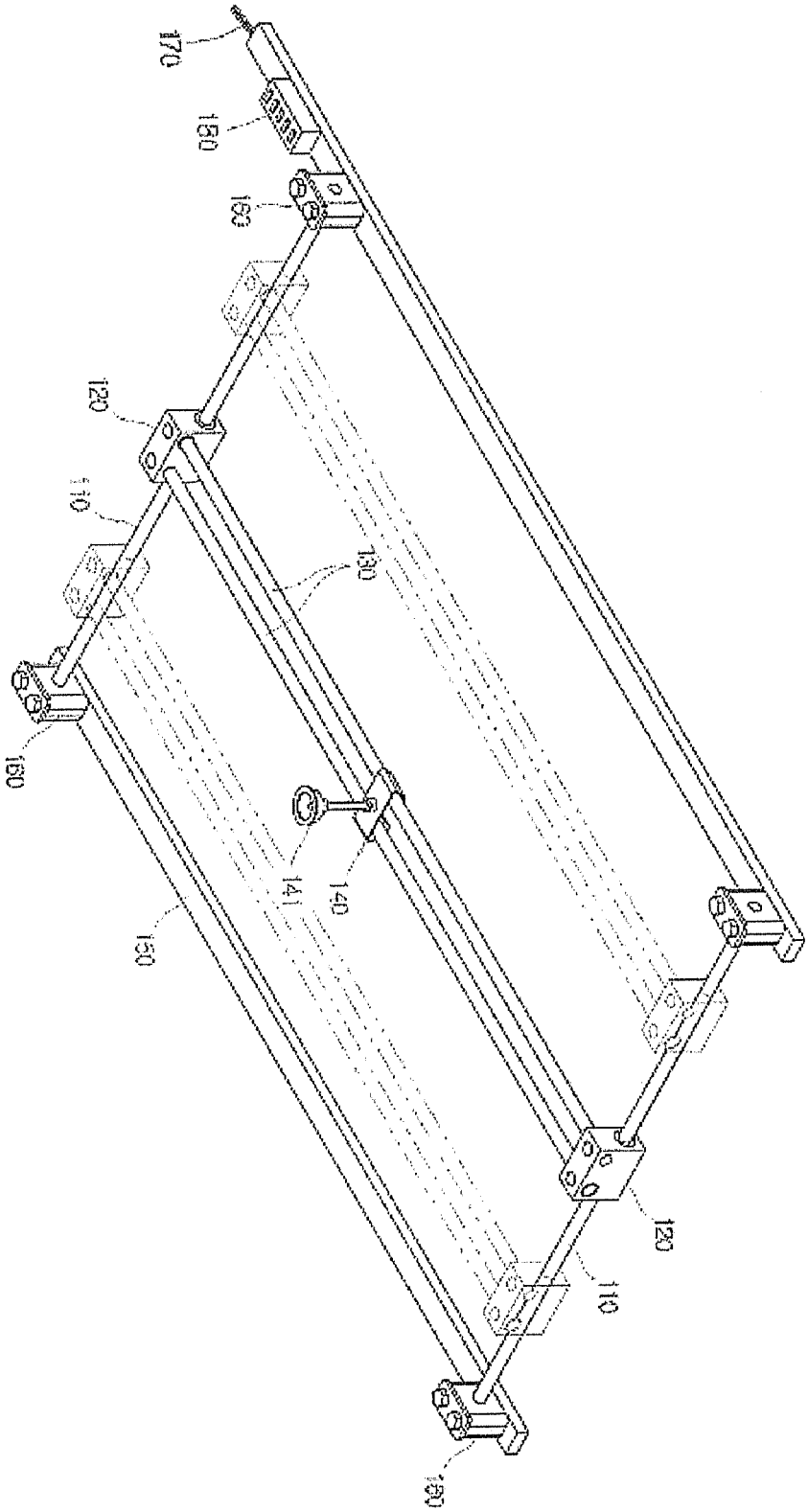
FIG. 1 is a perspective view schematically showing a movable lighting apparatus according to the present invention.

FIG. 1 is a perspective view schematically showing the whole structure of a movable lighting apparatus according to an embodiment of the present invention.

Wiring frames 150 having socket outlets 180 which are connected with power lines 170 in which various apparatuses are connected between the power lines 170 via the socket outlets 180, are installed in parallel on the ceiling. First and second slide bars 110 are installed in perpendicular between the wiring frames 150 so that the power lines of the negative and positive polarities are supplied to the first and second slide bars 110, respectively.

The wiring frames 150 can be implemented into a molded member formed of a known cover and main body. However, it is possible to use a fixed type cable having various types of built-in power lines.

Additionally, the power lines of the negative and positive polarities in the wiring frames 150 are connected to the first and second slide bars 110, respectively, as a single strand monopole. Thus, the slide bars 110 can be exposed wires of the negative and positive polarities, respectively. The exposed wires can be insulated with separate insulation covers (not shown) after the movable lighting apparatus according to the present invention has been finally installed on the ceiling. Otherwise, the exposed wires can be left alone. Even if the exposed wires are left alone, there is no problem of a short-circuit unless the exposed wires contact the moisture or conductive member.

Sliders 120 are movably installed on the first and second slide bars 110 to which the power lines of the negative and positive polarities are applied, respectively. The sliders 120 can contact and move along the first and second slide bars 110. Accordingly, the power sources of the corresponding slide bars 110 are supplied to the sliders 120, respectively.

Prior to installing the movable lighting apparatus according to the present invention, a number of the slide bars 110 and 130, the sliders 120 which can move along the slide bars 110, and the illumination/connection power connectors 140 which can move along the slide bars 130, are designed in accordance with an indoor area. The illumination/connection power connectors of various shapes and designs can be installed in accordance with illumination locations.

In the present invention, the description of the structures and components which are identical or similar will be omitted.

Therefore, the movable lighting apparatus according to the present invention will be described based on a model shown in the drawings.

Figure 2:
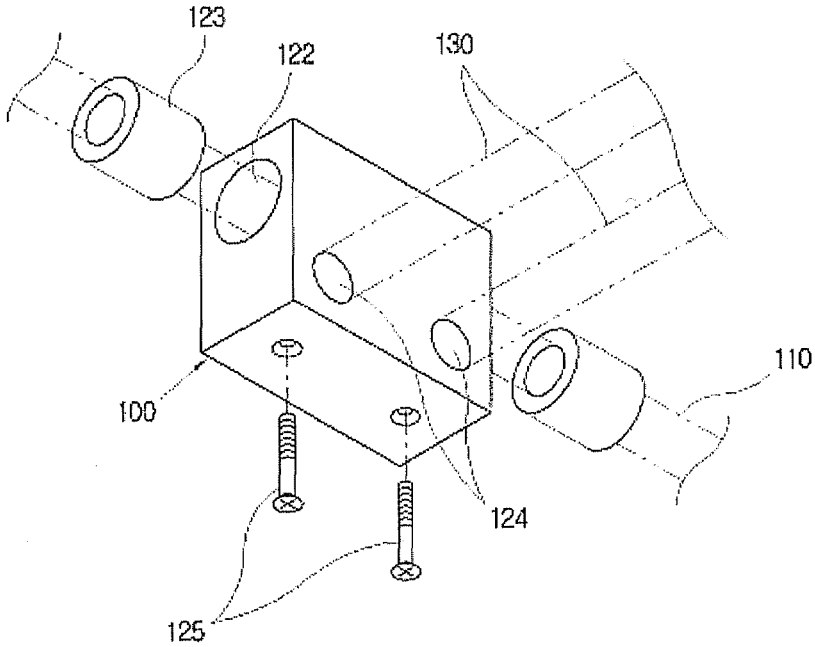
FIG. 2 is a disassembled perspective view of a slider for use in a movable lighting apparatus according to a first embodiment of the present invention.
Figure 3A:
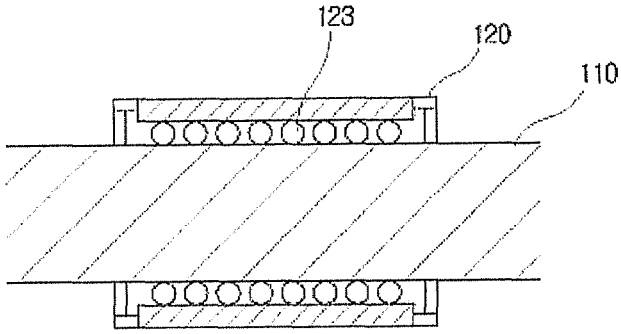
FIGS. 3A through 3C are cross-sectional views showing various installation states of the slider for use in the movable lighting apparatus according to the first embodiment of the present invention.
Figure 3B:
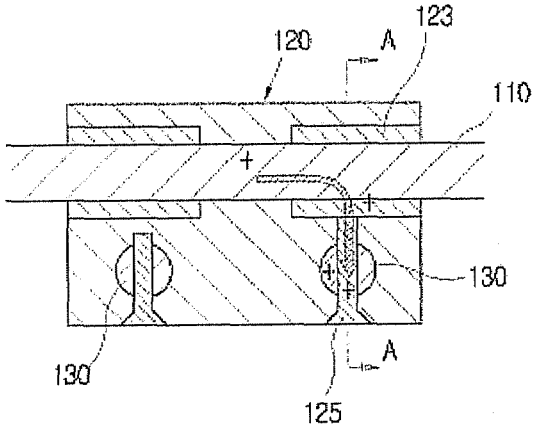
Figure 3C:
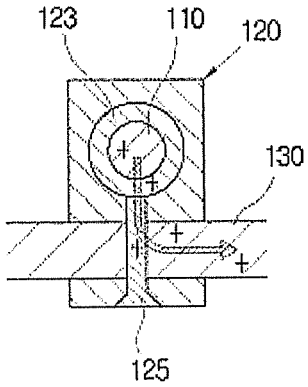

FIG. 2 is a disassembled perspective view of a slider for use in a movable lighting apparatus according to a first embodiment of the present invention. FIGS. 3A through 3C are cross-sectional views showing various installation states of the slider for use in the movable lighting apparatus according to the first embodiment of the present invention.

Referring to FIGS. 2 to 3C, the slider 120 includes: an insulation body in which a throughhole 122 is formed so that each of the first and second slide bars 110 is penetrated through the throughhole 122, conductive bearings 123 formed of metal balls 123*a* are formed in the inner side of the insulation body, and a plurality of throughholes 124 are formed through which the third and fourth slide bars 130 are penetrated, respectively. The plurality of the throughholes 124 are formed in perpendicular with and not to meet the throughhole 122. Here, the third and fourth slide bars 130 are fixed through the throughholes 124 through which the third and fourth slide bars 130 are penetrated by means of conductive bolts 125. Thus, the electric power of the first and second slide bars 110 is applied to the third and fourth slide bars 130 via the conductive bearings 123 and the conductive bolts 125.

Figure 3D:
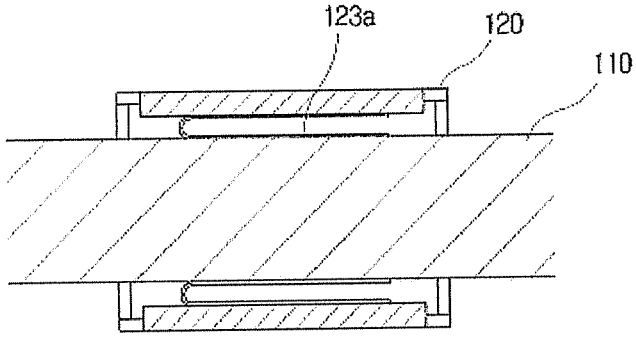
FIG. 3D is a cross-sectional view showing a slider to which a conductive plate spring is applied for use in a movable lighting apparatus according to the present invention.

In the meantime, FIG. 3D is a cross-sectional view showing a slider to which a conductive plate spring is applied for use in a movable lighting apparatus according to the present invention.

As shown in FIG. 3D, instead of the conductive bearings 123, the plate springs 123*a* can be used as a sliding contact and electrification unit.

Figure 4:
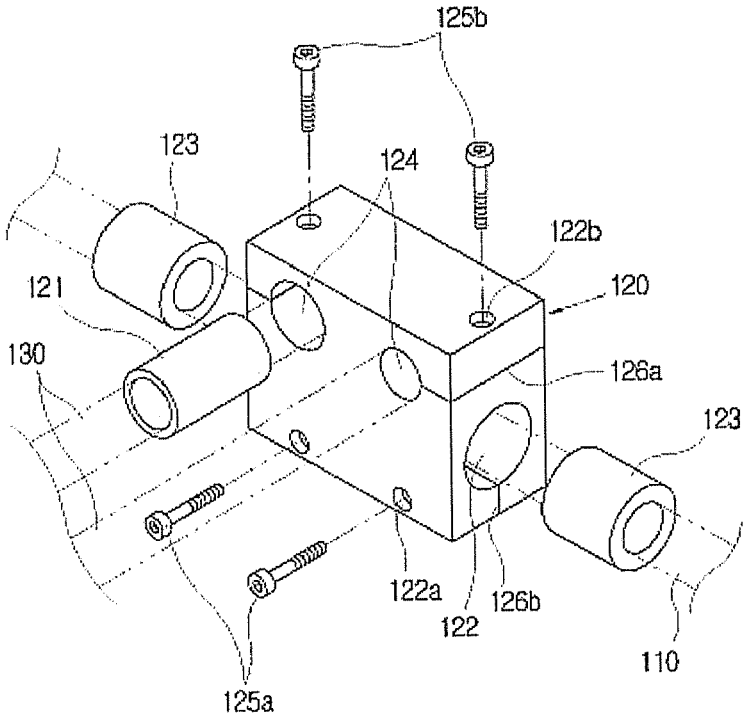
FIG. 4 is a disassembled perspective view showing a slider according to a second embodiment of the present invention.
Figure 5A:
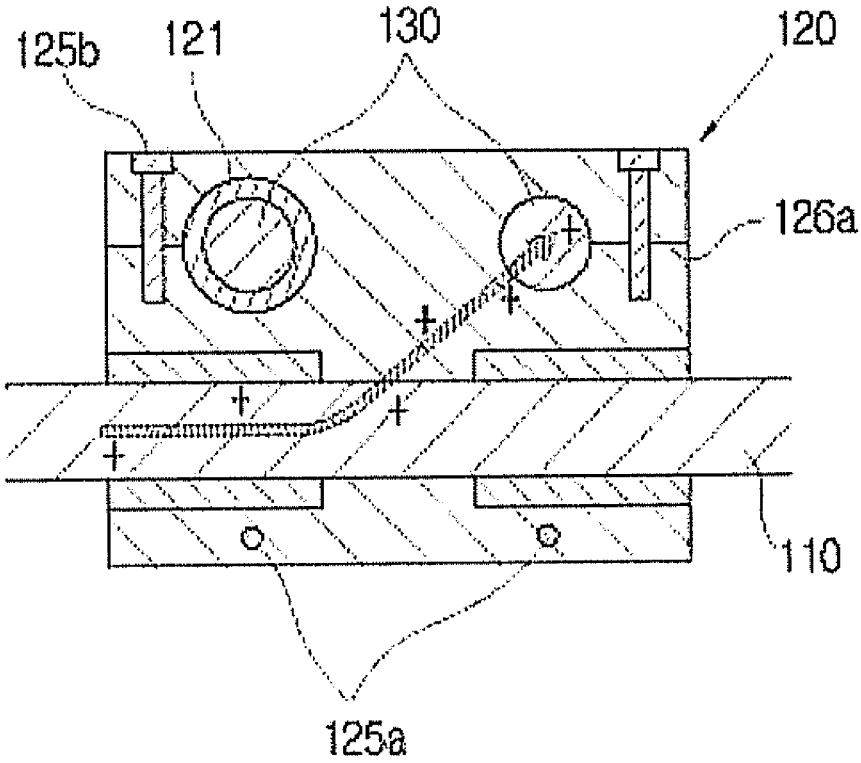
FIGS. 5A and 5B cross-sectional views showing various installation states of the slider for use in the movable lighting apparatus according to the second embodiment of the present invention.
Figure 5B:
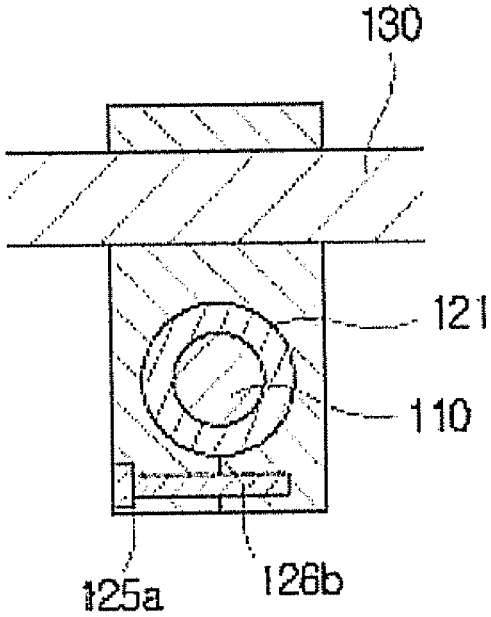

FIG. 4 is a disassembled perspective view showing a slider according to a second embodiment of the present invention. FIGS. 5A and 5B cross-sectional views showing various installation states of the slider for use in the movable lighting apparatus according to the second embodiment of the present invention.

Referring to FIGS. 4 through 5B, the slider 120 includes: a metal body in which a throughhole 122 is formed so that each of the first and second slide bars 110 are penetrated through the throughhole 122, conductive bearings 123 formed of metal balls 123*a* are formed in the inner side of the metal body, and a plurality of throughholes 124 are formed through which the third and fourth slide bars 130 are penetrated, respectively. The plurality of the throughholes 124 are formed in perpendicular with and not to meet the throughhole 122. Here, an insulation sleeve 121 is penetrated and inserted through one of the throughholes 124. Accordingly, a risk of a short circuit can be prevented since the electric power lines of the respectively different polarities do not contact each other. Thus, electric power of the first and second slide bars 110 is applied to only one of the third and fourth slide bars 130 having no insulation sleeve 121 via the metal balls 123*a* of the conductive bearings 123.

Figure 6:
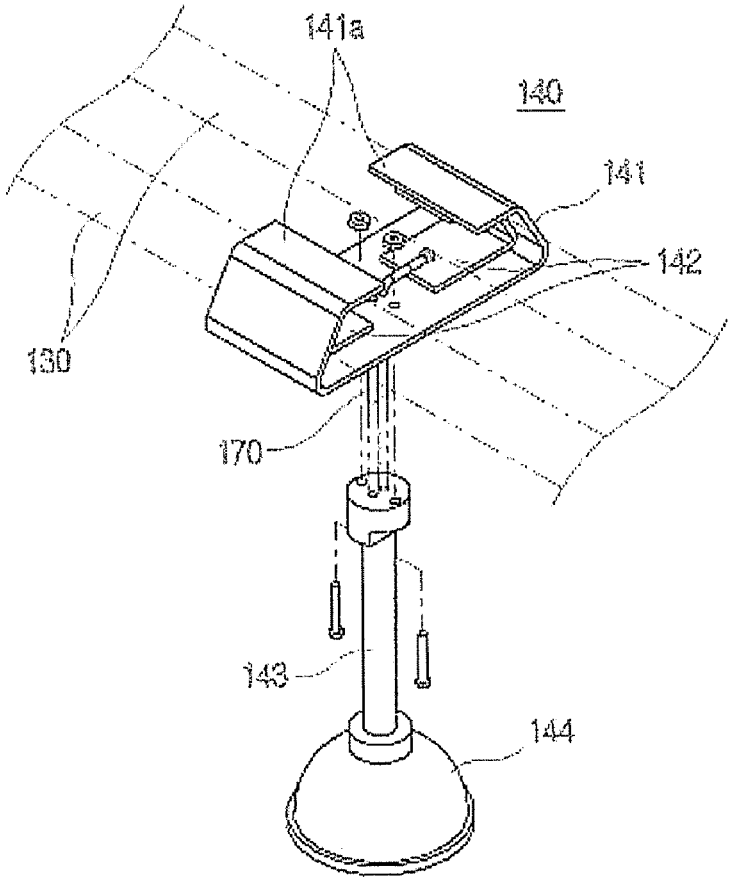
FIG. 6 is a perspective view showing an illumination/connection power connector for use in a movable lighting apparatus according to an embodiment of the present invention.
Figure 7A:
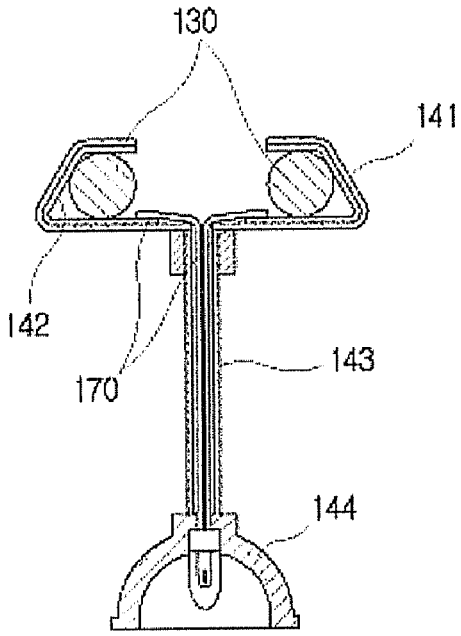
FIG. 7A is a cross-sectional view showing the illumination/connection power connector for use in the movable lighting apparatus according to the present invention.
Figure 7B:
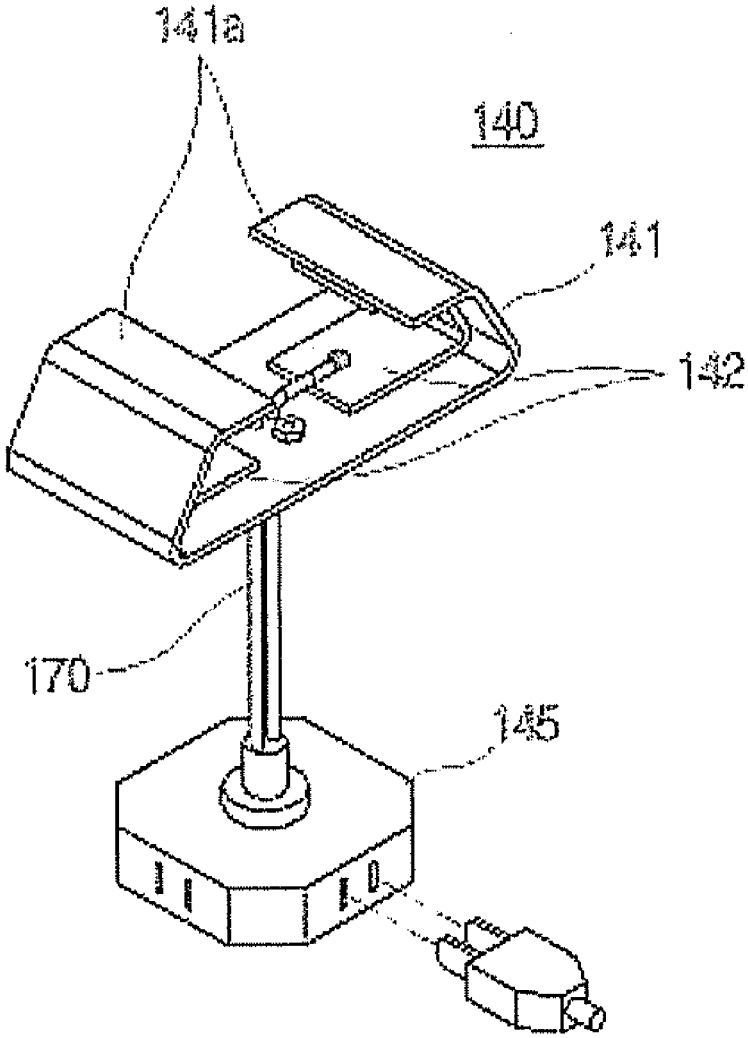
FIG. 7B is a perspective view schematically showing an illumination/connection power connector for use in a movable lighting apparatus according to another embodiment of the present invention.

FIG. 6 is a perspective view showing an illumination/connection power connector for use in a movable lighting apparatus according to an embodiment of the present invention. FIG. 7A is a cross-sectional view showing the illumination/connection power connector for use in the movable lighting apparatus according to the present invention. FIG. 7B is a perspective view schematically showing an illumination/connection power connector for use in a movable lighting apparatus according to another embodiment of the present invention.

Referring to FIGS. 6 through 7B, the illumination/connection power connector 140 according to the present invention includes an illumination socket 144 to which predetermined power lines 170 are withdrawn through the slide bars 130.

In detail, the illumination/connection power connector 140 includes: a body 141 at both upper sides of which catching portions 141*a* are formed and extended and bent upwards so as to contact the third and fourth slide bars 130 in a sliding contact mode, and whose lower portion is connected in a plate form; and conductive contact plates 142 formed in the inner sides of both the catching portions 141*a*, respectively, so that electric power can be supplied to power lines 170 in a suspended member 143 which is located below the illumination/connection power connector 140. That is, the suspended member 143 having built-in power lines 170 withdrawn from the contact plate 142 is connected to a socket 144.

The socket 144 can be implemented to have various kinds of structures according to the kinds of lamps. The suspended member 143 has built-in power lines 170 and is connected to the socket 144. As being the case, it is possible to implement the suspended member into a flexible suspended member whose length can be adjusted as is well known.

Particularly, as shown in FIG. 7B, the illumination/connection power connector 140 can provide a power connection member 145 to which predetermined power lines 170 are withdrawn from the slide bars 130. The power supply source of any other electric appliances in addition to the illumination fixtures can be provided through the implementation of the connection member 145.

The connection member 145 can be implemented into power connection members such as convenience outlets and receptacles with which power plugs can be connected.

Figure 8:
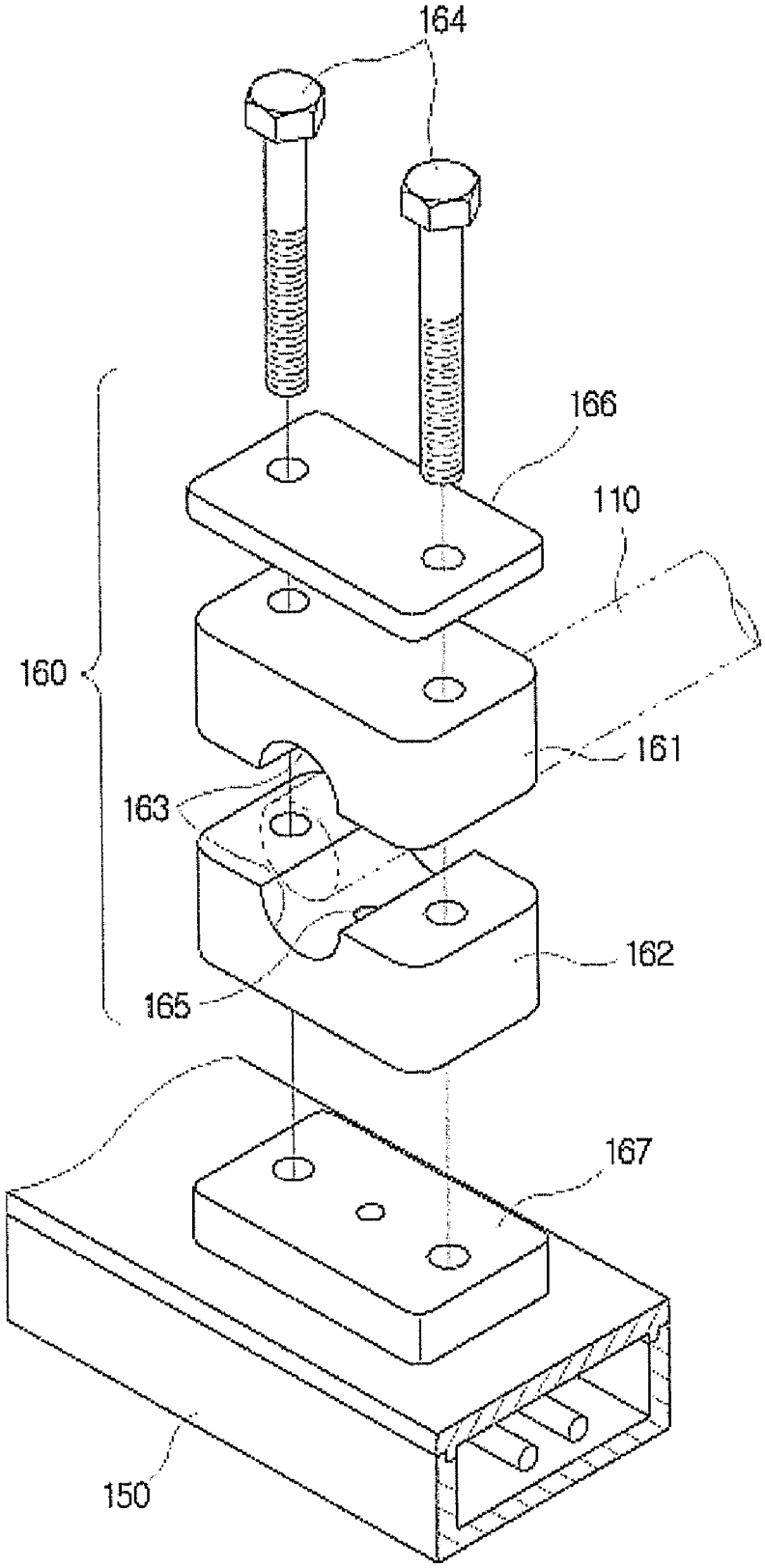
FIG. 8 is a disassembled perspective view showing, a main power connector for use in a movable lighting apparatus according to the present invention.
Figure 9A:
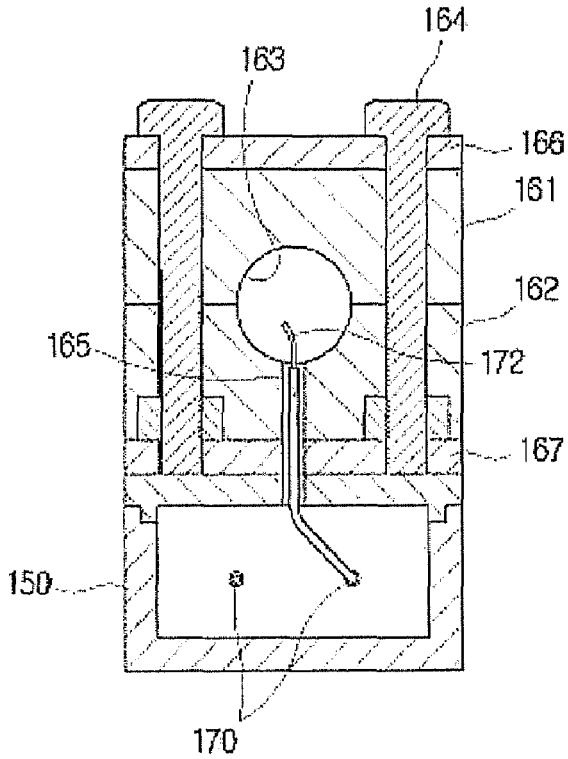
FIGS. 9A and 9B are cross-sectional views showing the main power connector of the present invention, respectively.
Figure 9B:
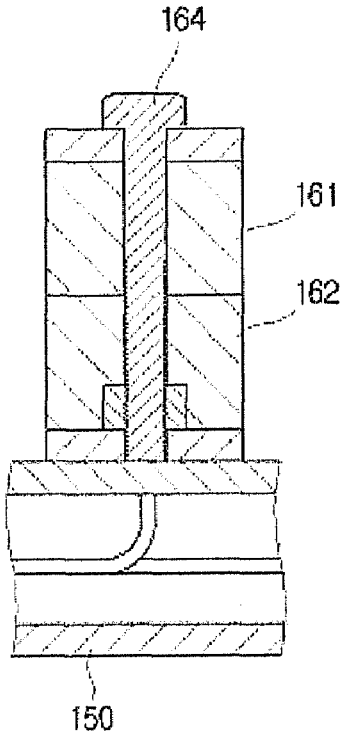

FIG. 8 is a disassembled perspective view showing a main power connector for use in a movable lighting apparatus according to the present invention. FIGS. 9A and 9B are cross-sectional views showing the main power connector of the present invention, respectively.

Referring to FIGS. 8 through 9B, a main power connector 160 includes upper and lower bodies 161 and 162 made of synthetic resin of an insulation material. A groove 163 is formed on the opposing surfaces of the upper and lower bodies 161 and 162, respectively. A guide hole 165 is penetrated on the groove 163 formed in the lower body 162. A bare wire 172 withdrawn from the wiring frame 150 is penetrated through the guide hole 165. The upper and lower bodies 161 and 162 are combined with each other using auxiliary members 166 and 167, by fixing bolts 164, respectively.

Figure 10:
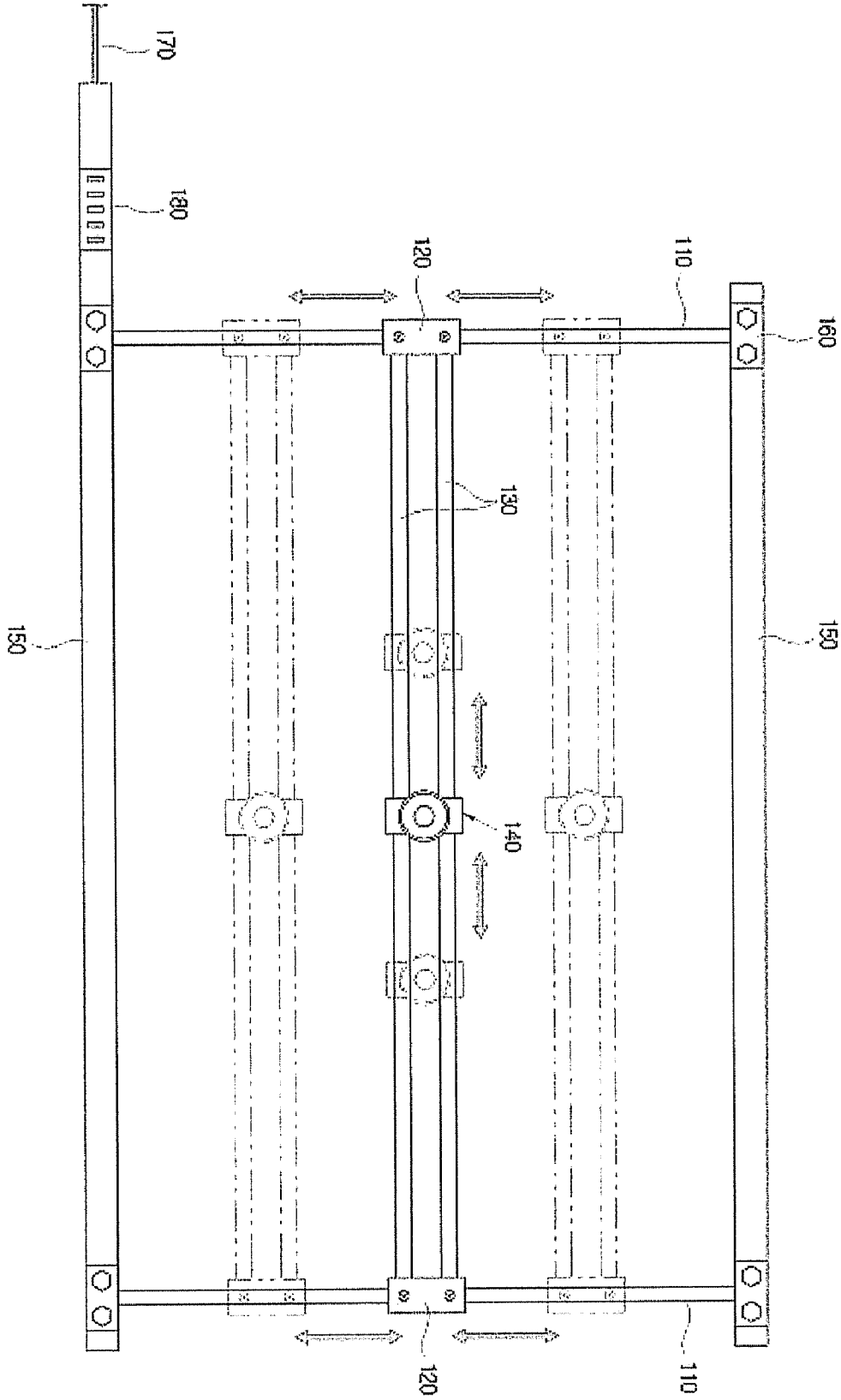
FIG. 10 is a schematic plan view for illustrating the overall operation of a movable lighting apparatus according to the present invention.
Figure 11A:
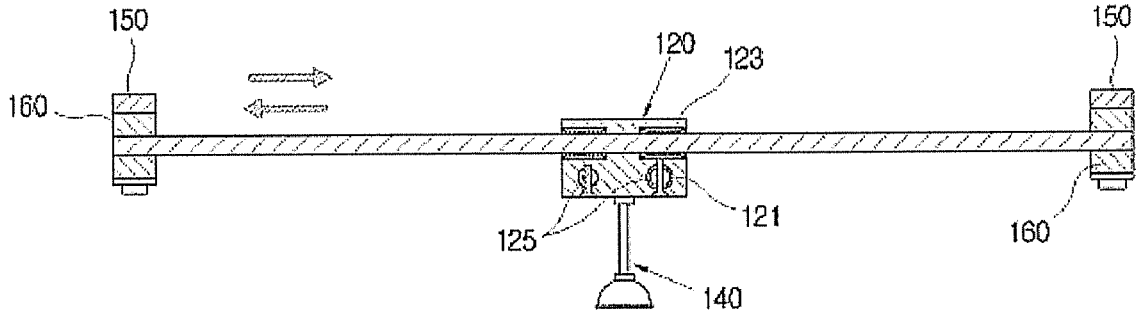
FIGS. 11A and 11B are cross-sectional views for illustrating the overall operation of a movable lighting apparatus according to the present invention, respectively.
Figure 11B:
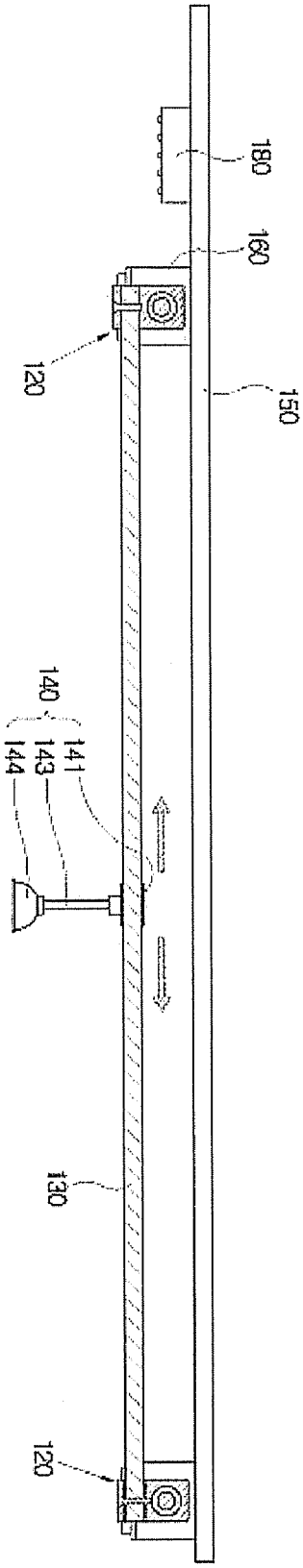

FIG. 10 is a schematic plan view for illustrating the overall operation of a movable lighting apparatus according to the present invention. FIGS. 11A and 11B are cross-sectional views for illustrating the overall operation of a movable lighting apparatus according to the present invention, respectively.

The movable lighting apparatus according to the present invention is provided with a switching unit which is well-known. The electric power is switched on and off by the switching unit, to thus turn on and off lamps via the illumination/connection power connector for use in the movable lighting apparatus according to the present invention.

Prior to installing the movable lighting apparatus according to the present invention, a number of the slide bars 110 and 130, the sliders 120 which can move along the slide bars 110, and the illumination/connection power connectors 140 which can move along the slide bars 130, are designed in accordance with an indoor area. The illumination/connection power connectors of various shapes and designs can be installed in accordance with illumination locations. The movable lighting apparatus according to the present invention will be described based on a model shown in the drawings.

In the movable lighting apparatus according to the present invention, movable sliders 120 move along the first and second slide bars 110 here and there, to thus perform positioning of the X-axis direction. The positioning of the X-axis direction of the slider 120 has been performed, and then positioning of the Y-axis direction of the slider 120 is performed through the illumination/connection power connector 140.

As described above, in the case of the illumination/connection power connector 140, the body 141 can move at the state of being electrified via the catching portion 141*a* which can slidably move along the third and fourth slide bars 130. However, a long term use of the illumination/connection power connector 140 may accumulate conducting impurities thereon and thus cause a risk including spark. Accordingly, it is desirable that the switching unit should move after the electric power has been disconnected.

Hereinafter, a movable lighting apparatus according to another preferred embodiment of the present invention will be described below.

Figure 12:
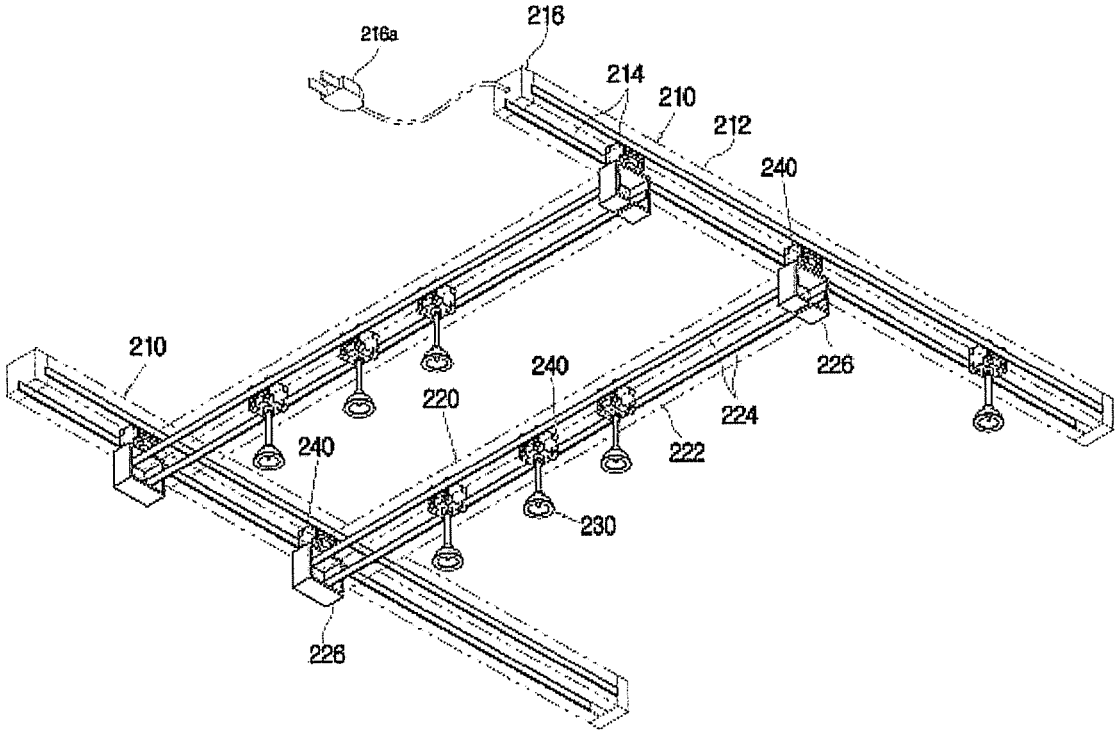
FIG. 12 is a perspective view showing a movable lighting apparatus according to another embodiment of the present invention.
Figure 13A:
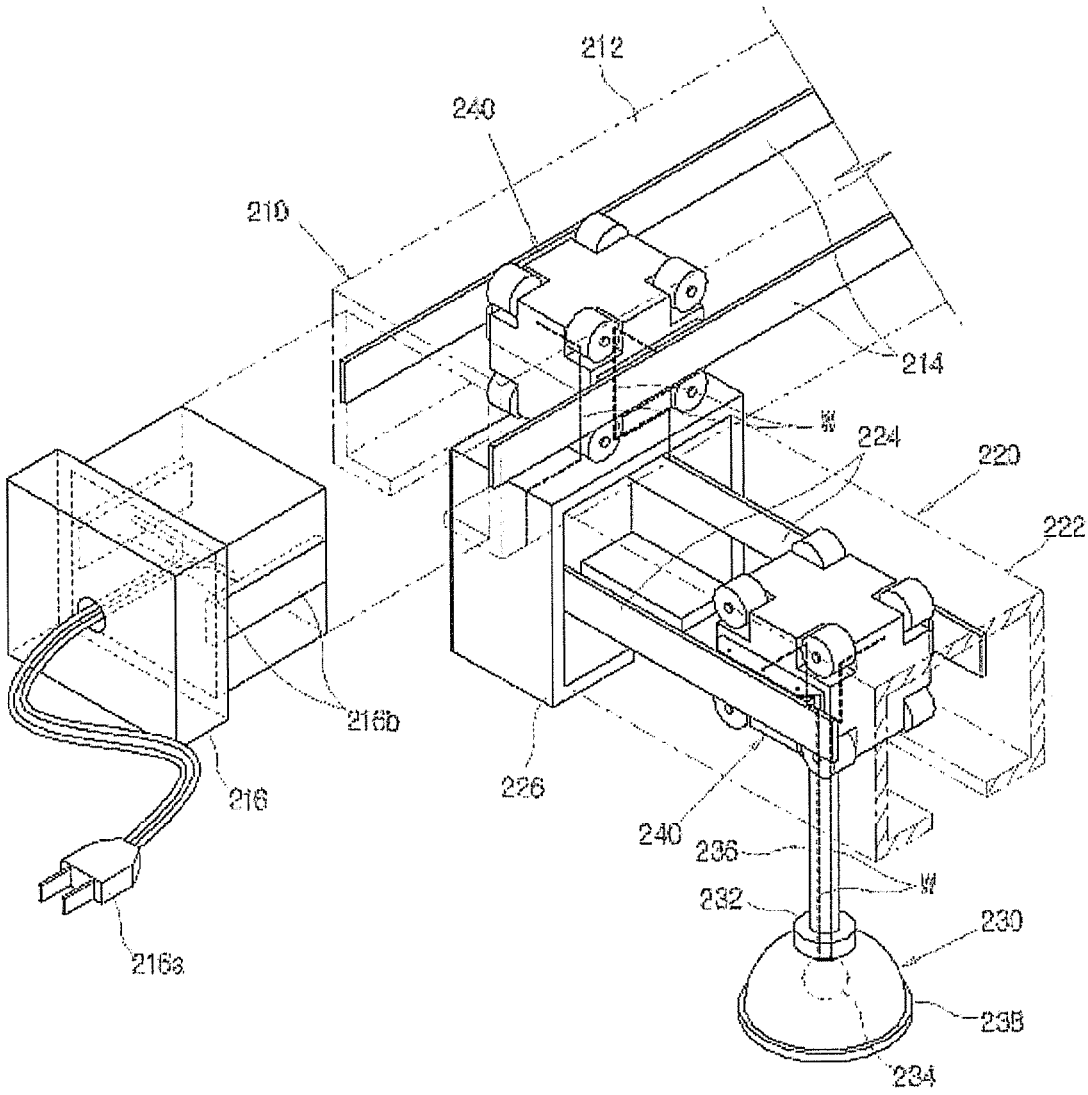
FIGS. 13A and 13B are partially enlarged views of the movable lighting apparatus according to another embodiment of the present invention, respectively.
Figure 13B:
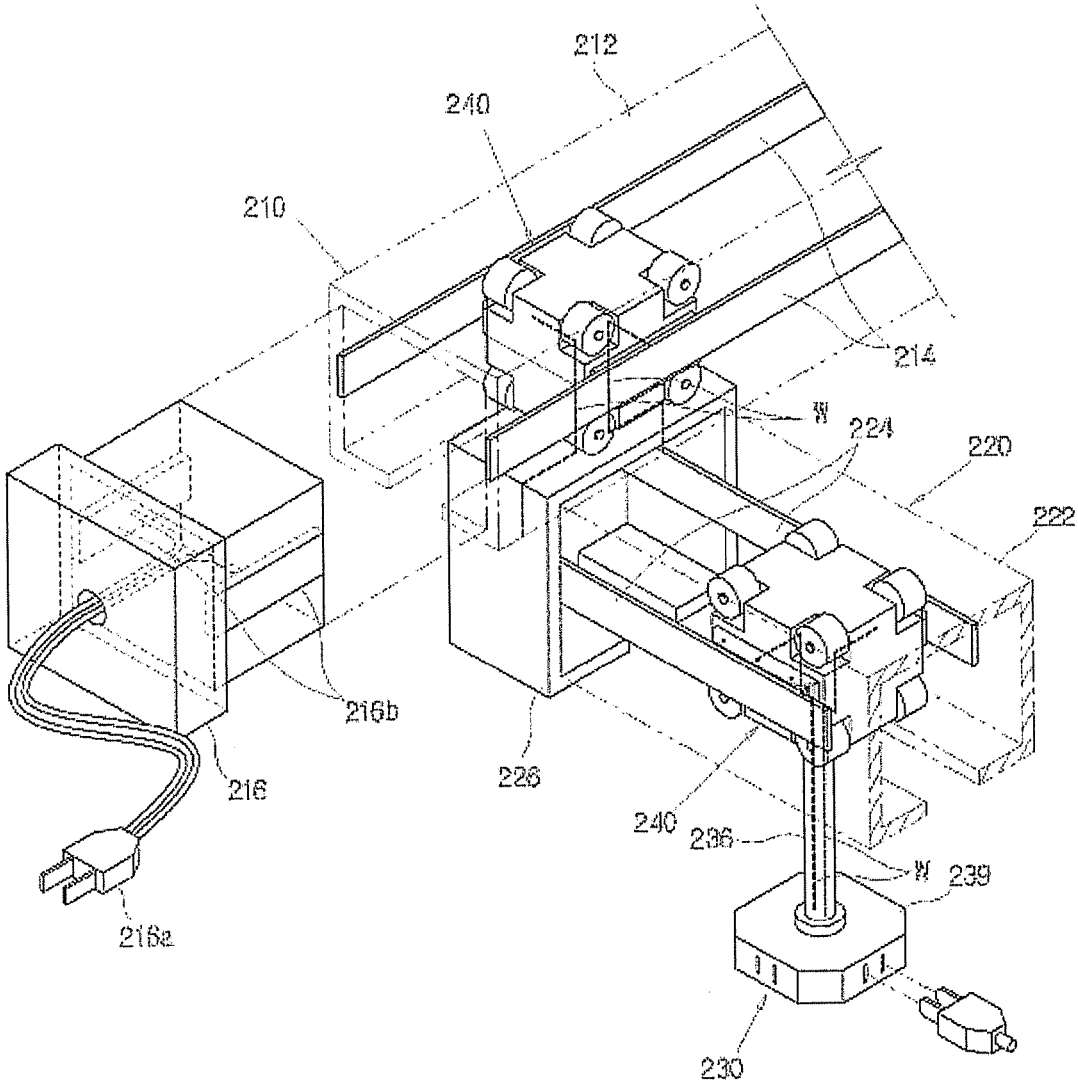
Figure 14:
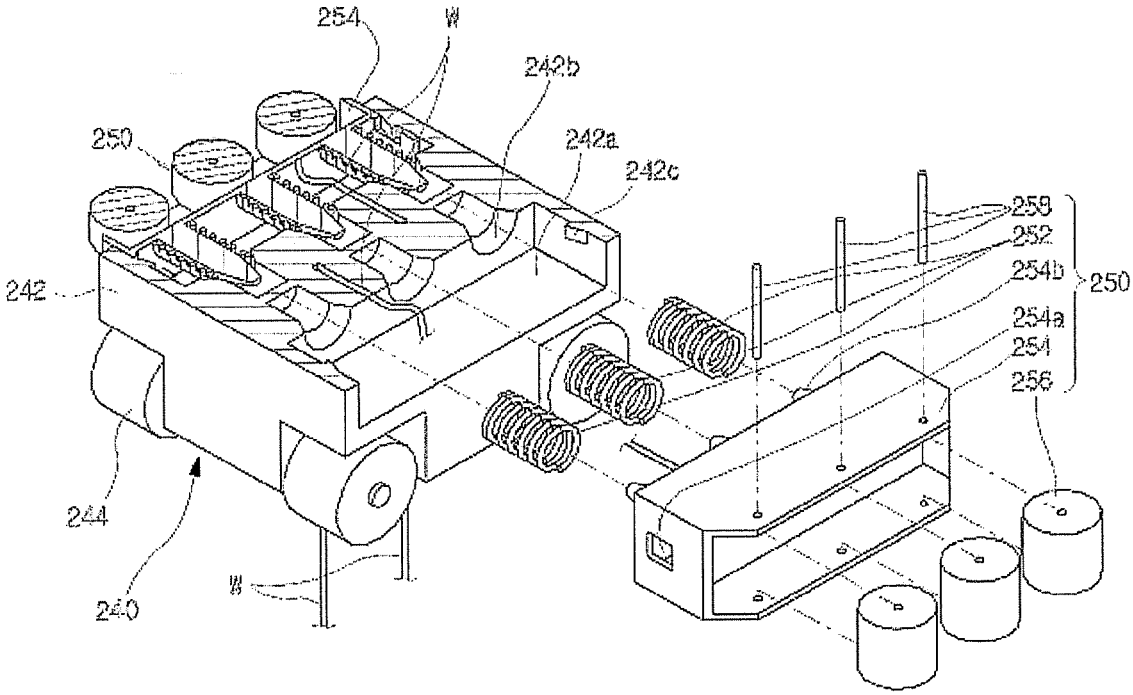
FIG. 14 is a disassembled perspective view showing a movable unit according to another embodiment of the present invention.

FIG. 12 is a perspective view showing a movable lighting apparatus according to another embodiment of the present invention. FIGS. 13A and 13B are partially enlarged views of the movable lighting apparatus according to another embodiment of the present invention, respectively. FIG. 14 is a disassembled perspective view showing a movable unit according to another embodiment of the present invention.

Referring to FIGS. 12 through 14, a movable lighting apparatus according to another embodiment of the present invention includes a pair of fixed rails 210 which are disposed on the ceiling, at least one movable rail 220 which is cross-linked perpendicularly with the fixed rails 210, an illumination/connection power connection member 230, and a movable unit 240 which slidably moves along the fixed rails 210 and the movable rail 220.

The fixed rail 210 is formed of a frame 222 having a rectangular cross-section whose lower central portion is opened, and has bar-shaped terminals 224 to which negative and positive electric power voltages are applied in both sides of the fixed rail frame 222. The pair of the fixed rails 210 are disposed on the ceiling in parallel with each other. A power supply cover 216 is detachably assembled with one end of the fixed rail 210. A power plug 216*a* is formed through an opening formed on the cover 216. The power plug 216*a* is connected to connection ends 216*b* which are connected to the bar-shaped terminal 224.

The movable rail 220 is formed of a frame 222 having a rectangular cross-section whose lower central portion is opened, and has bar-shaped terminals 224 to which negative and positive electric power voltages are applied in both sides of the movable rail frame 222. The movable rail 220 is cross-linked perpendicularly with the fixed rails 210 between the fixed rails 210. Rectangular fixing frames 226 larger than the size of the frame 222 are combined with both ends of the movable rail 220, respectively.

In order to allow the fixing frames 226 to cover both ends of the movable rail 220, it is desirable that an insertion structure is implemented into a simple cap structure. When an appropriate number of movable units 240 are filled in the inner side of the movable rail 220, the fixing frames 226 can be fixed by for example a welding process.

The illumination/connection power connection member 230 shown in FIG. 13A, includes a socket 232 to which the electric power of the negative and positive polarities is supplied, a lamp 234 which is coupled with the socket 232 to emit light, a connection tube 236 which is fixed to the upper portion of the socket 232, and a lamp shade 238 which is fixed to the socket 232, surrounding the upper portion of the lamp 234.

The illumination/connection power connection member 230 shown in FIG. 13B, includes a receptacle 239 for power plug connection. The electric power is supplied to the receptacle 239 via the connection tube 236 which is fixed in the upper portion of the socket 232. Accordingly, illumination/connection power connection member 230 has a function of a receptacle or socket outlet through which respective plugs of various kinds of appliances can be connected.

The movable unit 240 shown in FIG. 14 includes: a body 242 having accommodating grooves 242*a* formed on the either side of the movable unit 240, and guide grooves 242*b* and inclined pieces 242*c* formed in the inner sides of the accommodating grooves 242*a*, so as to be inserted into the inner side of the fixed rail 210 or movable rail 220; and movable wheels 244 fixed to the respective edges of the body 242. The body 242 is inserted into the accommodation grooves 242*a* to provide a connection member 250 connected to the bar-shaped terminals 224.

The movable unit 240 is connected with the upper ends of the connection tube 236 of the illumination/connection power connection member 230 in order to electrify the illumination/connection power connection member 230, and inserted into the fixed rails 210 and the movable rail 220, to then move along the fixed rails 210 and the movable rail 220.

The connection member 250 includes an elastic member 252, guide pins 254*b* which are elastically supported by the elastic member 252, and go in and out forwardly from a housing 254, the housing 254 which is provided with an elongate hole 254*a* through which the inclined piece 242*c* is inserted, rollers 256 which idly rotate at the end of the housing 254, and fixing pins 258 fixing the rollers 256 to the housing 254.

In the meantime, the electric power is supplied to the fixed rails 210 and the movable rail 220 through the electric cable wire W which connects the connection member 250 of the movable unit 240 and the bar-shaped terminals 224 of the movable rail 220, while penetrating the movable unit 240 which moves in a sliding manner along the fixed rails 210. The movable rail 220 and the illumination/connection power connection member 230 are electrified by the electric cable wire W which connects the connection member 250 of the movable unit 240 and the socket 232 of the illumination/connection power connection member 230, while penetrating the movable unit 240 which moves in a sliding manner along the movable rails 220.

The movable illumination/connection power connector formed of an illumination/connection power connection member 230 and a movable unit 240 according to the present invention will be described below.

Figure 15:
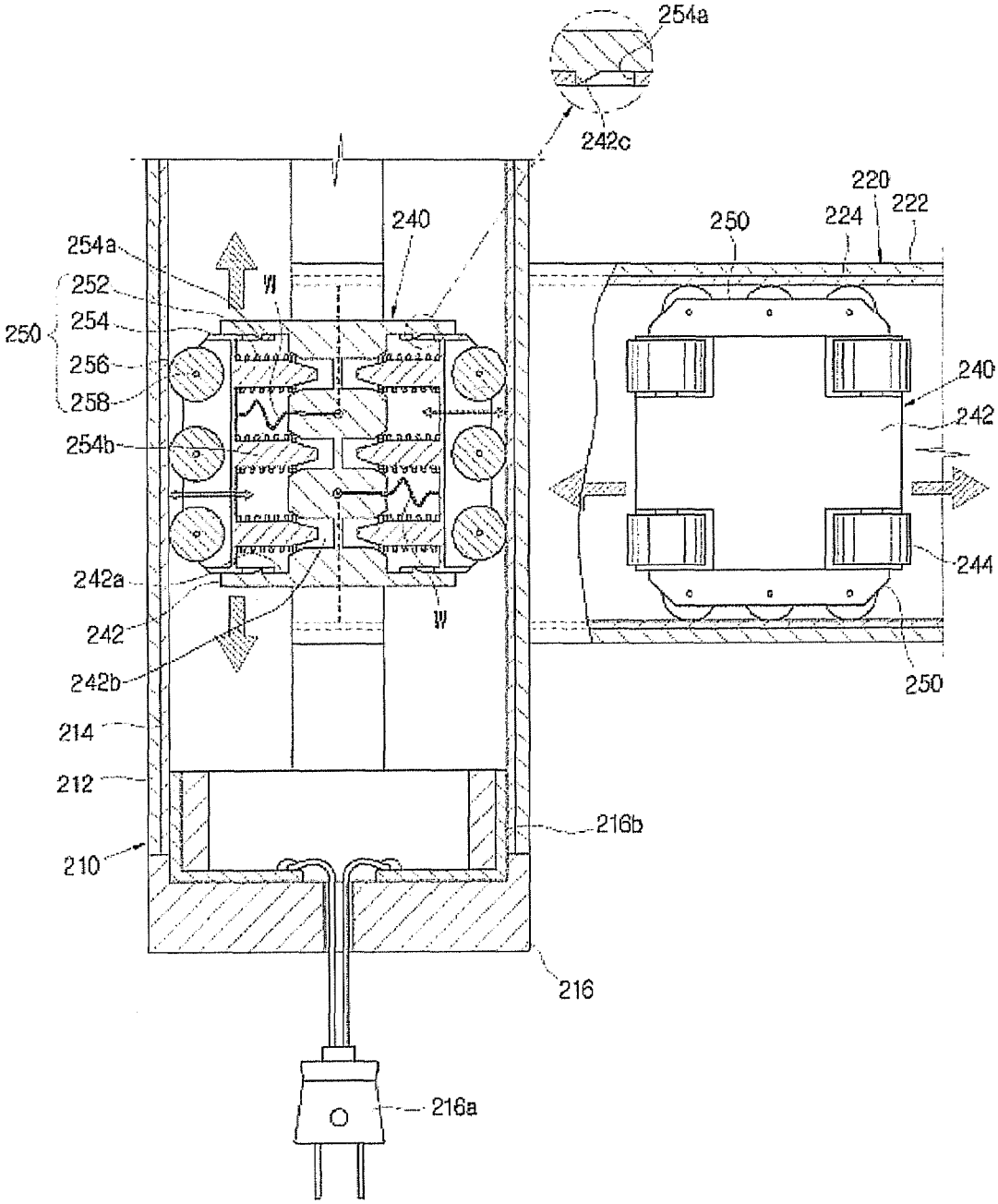
FIG. 15 is a top cross-sectional view of a movable illumination/connection power connector according to another embodiment of the present invention.
Figure 16A:
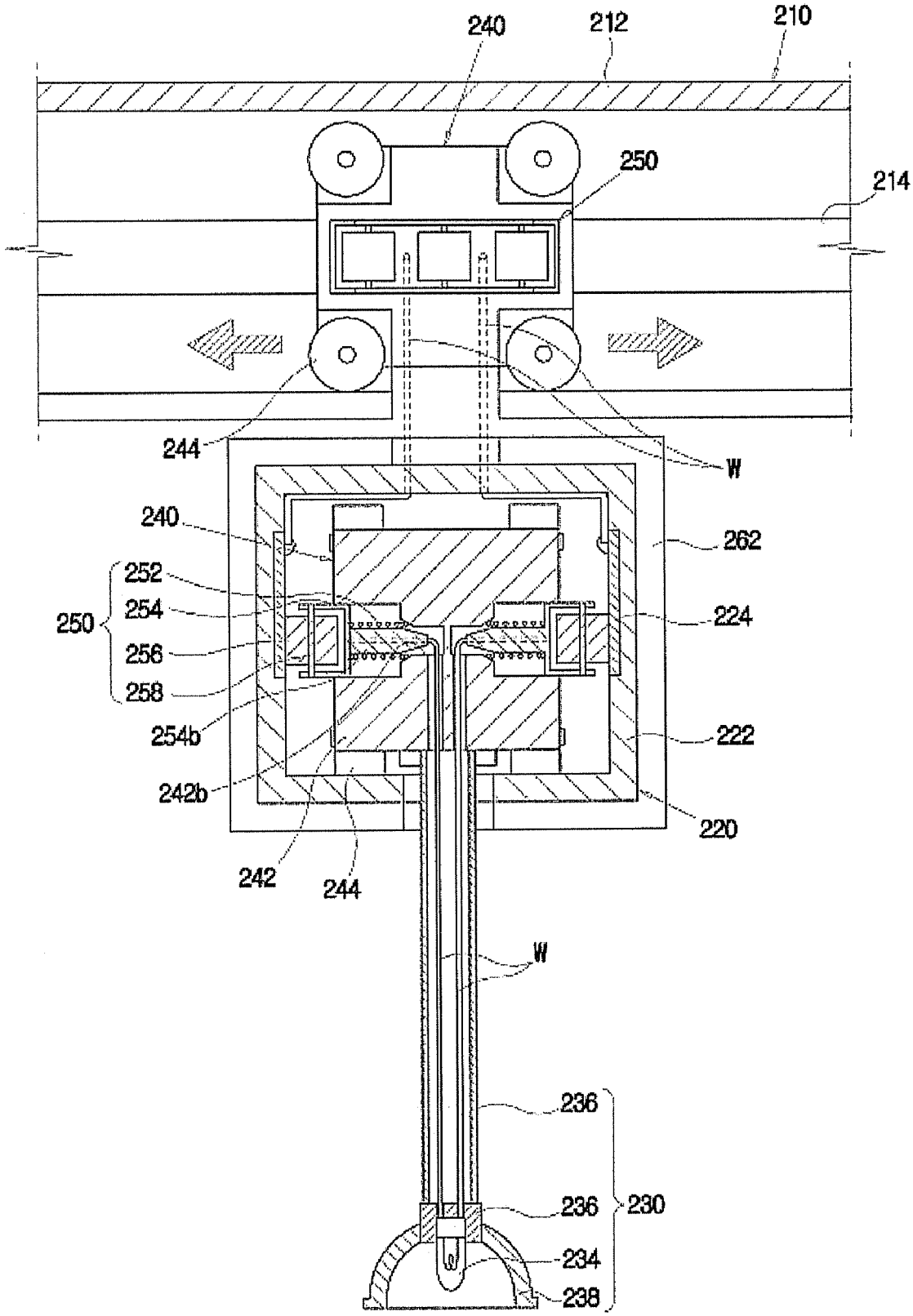
FIG. 16A is a front cross-sectional view of the movable illumination/connection power connector according to another embodiment of the present invention.
Figure 16B:
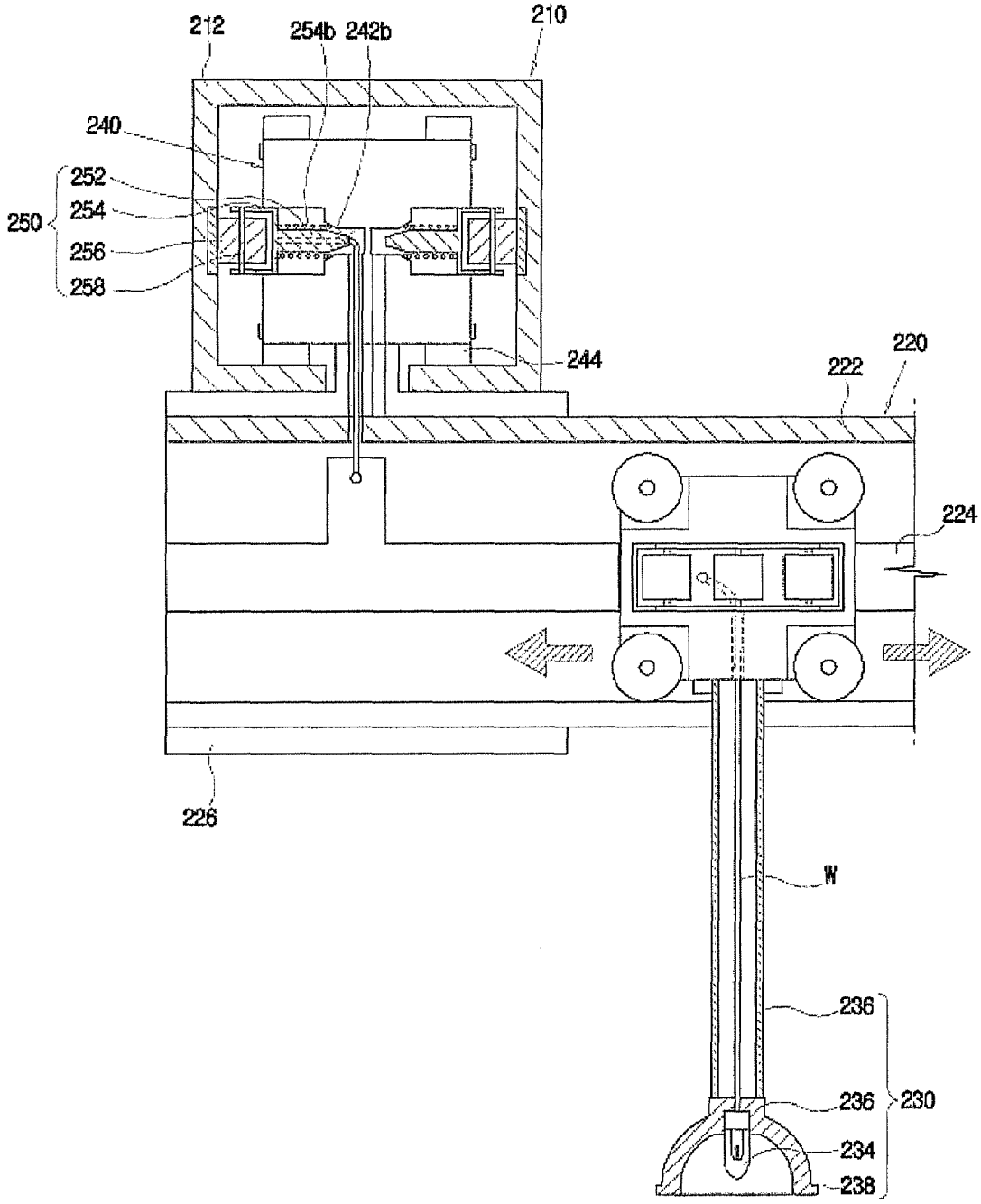
FIG. 16B is a lateral cross-sectional view of the movable illumination/connection power connector according to another embodiment of the present invention.

FIG. 15 is a top cross-sectional view of a movable illumination/connection power connector according to another embodiment of the present invention. FIG. 16A is a front cross-sectional view of the movable illumination/connection power connector according to another embodiment of the present invention. FIG. 16B is a lateral cross-sectional view of the movable illumination/connection power connector according to another embodiment of the present invention.

Firstly, referring to FIG. 15, a cover 216 which receives external electric power through a power plug 216*a* is inserted into one end of the frame 212 of the fixed rail 210. Connection ends 216*b* of the cover 216 are connected with terminals 214 of the fixed rail 210, respectively. Accordingly, the illumination/connection power connector receives the electric power of the negative and positive polarities to then be electrified.

The movable unit 240 is inserted into the inner side of the fixed rail 210 in a sliding manner. The connection member 250 is inserted into the accommodating grooves 242*a* which are formed in both sides of the movable unit 240, respectively. The rollers 256 are rotatably fixed to the leading end of the housing 254 of the connection member 250 by means of the fixing pins 258, to thus slidably contact the terminals 224. The guide pins 254*b* are formed in the rear end of the housing 254 of the connection member 250. The elastic body 252 is elastically supported by the guide pins 254*b*. Then, the guide pins 254*b* go in and out toward the guide hole 242*b*. Thus, the rollers 256 elastically contact the terminals 224, to then allow the connection member 250 to be electrified.

The connection member 250 is inserted into the accommodating grooves 242*a* of the movable unit 240. The inclined pieces 242*c* formed in both side of the inner walls of the accommodating grooves 242*a* are inserted into the elongate hole 254*a* so that the connection member 250 is combined into the accommodating grooves 242*a* so as not to secede from the accommodating grooves 242*a*. Accordingly, the connection member 250 can move forward and backward.

Then, one end of the wire W is soldered in the inner side of the housing 254 of the connection member 250, and the other end of the wire W passes through the body 242 of the movable unit 240 and connected with the terminals 224 of the movable rail 220 arranged perpendicularly with the lower portion of the fixed rail 210.

Therefore, the terminals 224 in both sides of the fixed rails 210 provided with the external power supply with the power plug 216*a* are electrified with the terminals 224 of the movable rail 220 which is crossed perpendicularly with the lower portion of the fixed rail 210. When the movable rail 220 moves, the movable unit 240 inserted into the fixed rails 210 slides along the fixed rails 210 and the connection member 250 of the movable unit 240 elastically contacts the terminals 224. Accordingly, the power lines of the negative and positive polarities can be sequentially supplied for the terminals 224 located at both sides of the movable rail 220.

Moreover, the movable unit 240 is inserted into the inner side of the movable rail 220, and slidably moves in the inner side of the movable rail 220, through the movable wheels 244 formed at the respective edges of the body 242. Thus, the movable unit 240 receives the electric power from the terminals 224 of the movable rail 220 via the connection member 250 formed at both sides of the movable unit 240, and supplies the electric power to an illumination/connection power connector (not shown) which is fixed to the lower portion of the movable unit 240.

As shown in FIGS. 16A and 16B, the movable unit 240 inserted into the inner side of the fixed rails 210 slidably moves along the inner sides of the fixed rails 210 via the movable wheels 244 fixed to the upper and lower edges of the body 242. Here, the connection member 250 contacts the terminals 224 formed at both the sides of the inner portion of the movable rails 220. Accordingly, the terminals 224 and the connection member 250 are electrified with each other.

The upper ends of the electric cable wire W which passes through the movable unit 240, the movable rail 220, the fixing frames 226 and the lower ends of which are soldered to the terminals 224 of the movable rail 220 are soldered to the connection member 250. Thus, the connection member 250 and the terminals 224 of the movable rail 220 are electrified with each other. Therefore, the electric power of the negative and positive polarities is applied to the terminals 224 of the movable rail 210 disposed in both sides of the movable rail 210 via the connection member 250 of the movable unit 240.

In the meantime, the connection member 250 which is accommodated in the accommodating grooves 242*a* formed at both the sides of the body 242 of the movable unit 240 inserted inside the movable rail 220 contacts the terminals 224 of the movable rail 220. Accordingly, the movable unit 240 slidably moves to the lengthy direction in the movable rail 220 via the movable wheels 244.

Although the movable unit 240 moves, the conductive rollers 256 which are rotatably fixed in the leading end of the housing 254, contact the terminals 224 and thus the movable unit 240 receives the electric power. The movable unit 240 is electrified with the wire W which is soldered to the housing 254 via respective central pins of the rollers 256. The electric power is applied to the illumination/connection power connection member 230 via the electric cable wire W. That is, the electric power is supplied to the socket 232 of the illumination/connection power connection member 230 via the electric cable wire W through the rollers 256 and the housing 254 of the movable unit 240 contacting the terminals 224 of the movable rail 220.

The illumination/connection power connection member 230 is fixed to the bottom of the movable unit 240 inserted into the movable rail 220 by means of the connection tube 236. The lamp 234 is combined with the socket 232 fixed to the lower end of the connection tube 236, and then the electric power is applied to the socket 232, to then be turned on. The light of the lamp 234 is reflected to one side by the lamp shade 238 fixed to the socket 232.

As shown in FIG. 16, a pair of the fixed rails 210 are fixed in parallel on the ceiling, and the movable rail 220 disposed at the lower portion of the fixed rails 210 perpendicularly with the fixed rails 210 is fixed to the movable unit 240 which slidably moves along the fixed rails 210. Thus, the movable rail 220 receives the electric power of the negative and positive polarities via the movable unit 240 from the fixed rails 210, and moves to a desired position along the fixed rails 210. As shown in FIG. 16B, the illumination/connection power connection member 230 disposed in the lower portion of the movable rail 220 is also fixed to the movable unit 240 which slidably moves along the movable rail 220, and receives the electric power of the negative and positive polarities via the movable unit 240 from the movable rails 220. Thus, the illumination/connection power connection member 230 also moves to a desired position.

Particularly, both the sides of the housing 254 of the connection member 250 inserted to both the sides of the movable unit body 240 is elastically supported by the elastic member 252. Accordingly, the connection member 250 is inserted into the inner side of the fixed rails 210 or the movable rail 220, both the sides of the connection member 250 is elastically supported. As a result, the connection member 250 elastically contacts the terminals 224 formed at both the sides of the connection member 250. Although the movable unit 240 leans to one side or vibrations are generated when the movable unit 240 moves, the housing 254 moves in the accommodation grooves 242*a* by the elasticity of the elastic member 252, and maintains the contact to the terminals 224, to thereby prevent the electric power from being disconnected.

Figure 17:
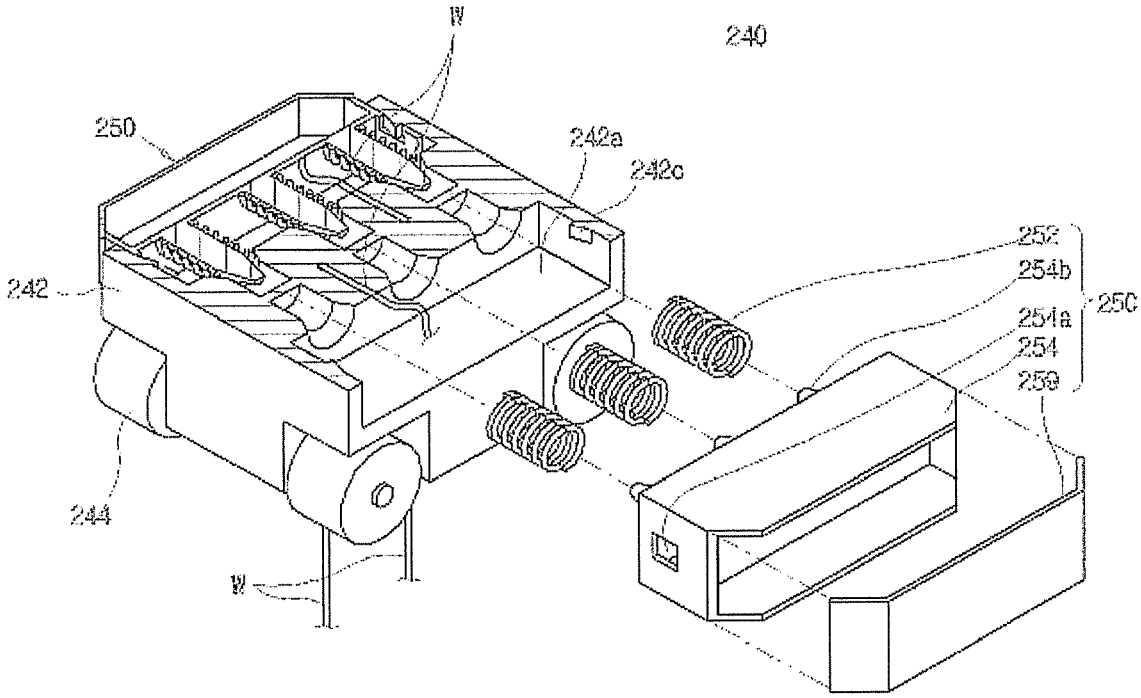
FIG. 17 is a disassembled perspective view showing a movable unit for use in a movable illumination/connection power connector according to another embodiment of the present invention.

FIG. 17 is a disassembled perspective view showing a movable unit 240 for use in a movable lighting apparatus, according to another embodiment of the present invention, in which power supply rollers are differently implemented. Here, differently from the embodiment that the rollers 256 are fixed to the housing 254 by the fixing pins 258 in the connection member 250, a coupling piece 259 whose both ends are bent at a certain angle, is fixed on the leading end of the housing 254 which is elastically supported with the elastic body 252 from the accommodating grooves 242 of the movable unit 240 of the body 242. The coupling piece 259 slidably contacts the terminals 224 of the fixed rails 210 or movable rail 220. Since the other components other than the coupling piece 259 are identical to those of the above-described embodiments of the present invention, the detailed description thereof will be omitted.

The coupling piece 259 is fixed to the leading end of the housing 254, and elastically supported from the movable unit 240. Accordingly, the movable unit 240 elastically contacts the terminals 224. As a result, although a gap is formed between the movable unit 240 and the terminals 224 when the movable unit 240 moves, the movable unit 240 maintains the contact state from the terminals 224 without having any gap from the terminals 224, and slidably moves along the terminals 224, to thus electrify the movable unit 240 continuously.

The movable lighting apparatus according to the present invention is mainly suitable for the ceiling lighting facility in the display booth for the short-term public relation. However, the movable lighting apparatus according to the present invention can be used for the illumination facilities for the long-term use, through a safer countermeasure. For example, in order to use the movable lighting apparatus according to the present invention as the illumination facilities for the long-term use, additional facilities such as insulation screens or reflection layers preventing fallouts or contact of the conductive fallout falling from above the movable lighting apparatus, or auxiliary members such as cover members covering the exposed sliders or slide bars are needed.

As described above, the present invention provides a newly proposed movable lighting apparatus which improves a conventional complicated illumination facility which is temporary, whose illumination location is frequently changed, and which requires for separate supports for supporting an electric power supply and lighting apparatuses, to thereby provide an effect in which a number of illumination lamps can be freely moved and illumination location can be frequently freely changed.

The present invention provides a movable lighting apparatus which is equipped with a fallout prevention unit for preventing conductive fallout from falling and is appropriate for places where an illumination facility is temporarily used in the short term and illumination location is frequently changed. Moreover, the present invention provides an effect of providing a power supply movable unit including one or two lines of power supply and movable rails which have a sufficient supporting force and a sliding function although negative and positive electric power lines are separated and exposed.

The present invention provides a movable lighting apparatus which provides an effect of a power supply slider which is appropriate for slide bars which are electrified by contact of the exposed lines, and enable a sliding movement.

The present invention provides a movable lighting apparatus which does not have any separate electric wiring cables, does not hamper with the wiring cables, and is simply installed since an illumination fixture receives electric power directly from rails to then be turned on.

The present invention provides a movable lighting apparatus which is provided with a connection power connector which is elastically supported at both sides of a movable unit which is inserted into rails to then be slided, so as to elastically contact power supply terminals while maintaining a contact state between the connection power connector and the power supply terminals, during moving.

The present invention provides a movable lighting apparatus which is equipped with movable wheels at respective edges of a movable unit so that the movable lighting apparatus can be smoothly slided along rails.

The present invention provides a movable lighting apparatus which includes a roller which is formed at the leading end of a connection power connector, so that the roller can rotate on power supply terminals to thereby minimize a contact friction, and in particular, includes a number of rollers to thus stabilize a contact state between the connection power connector and the power supply terminals.

As described above, the present invention has been described with respect to particularly preferred embodiments. However, the present invention is not limited to the above embodiments, and it is possible for one who has an ordinary skill in the art to make various modifications and variations, without departing off the spirit of the present invention.

The invention claimed is:

1. A movable lighting apparatus comprising:

first and second slide bars to which electric power of predetermined polarities is respectively applied;

sliders which move along the first and second slide bars, respectively and receive electric power by contact of a corresponding slide bar, respectively;

third and fourth slide bars which are connected between the sliders; and an illumination/connection power connector which supplies the movable lighting apparatus with electric power via the third and fourth slide bars and which is movable along the third and fourth slide bars to thus provide movable lighting illumination.

2. The movable lighting apparatus according to claim 1, wherein the first and second slide bars are connected perpendicularly with wiring frams having built-in power lines.

3. The movable lighting apparatus according to claim 2, further comprising a main power connector comprising: upper and lower bodies which are formed of non-conductive grooves between the first and second slide bars crossing perpendicularly with the left and right wiring frames and in which the bare wires which are withdrawn from the wiring frames are exposed; and fixing bolts.

4. The movable lighting apparatus according to claim 1, wherein the illumination/connection power connector further comprises an illumination socket to which predetermined power lines are withdrawn via slide bars.

5. The movable lighting apparatus according to claim 1, wherein the illumination/connection power connector comprises: a body at both upper sides of which a catching portion is formed and whose lower portion is connected in a plate form; conductive contact plates formed in the inner sides of both the catching portions, respectively; a suspended member having built-in power lines withdrawn from the contact plate; and a socket adhered to the suspended member.

6. The movable lighting apparatus according to claim 1, wherein the illumination/connection power connector is a power connection member to which a plug can be connected.

7. The movable lighting apparatus according to claim 1, wherein the slider comprises: an insulation body in which a throughhole is formed so that the first and second slide bars are penetrated through the throughhole, respectively, conductive bearings are formed in the inner side of the insulation body, and throughholes are formed through which the third and fourth slide bars are penetrated, wherein the third and fourth slide bars are fixed through the throughholes through which the third and fourth slide bars are penetrated as conductive bolts and the electric power of the first and second slide bars is applied to the third and fourth slide bars via the conductive bearings and the conductive bolts.

8. The movable lighting apparatus according to claim 1, wherein the slider comprises: a metal body in which a throughhole is formed so that the first and second slide bars are penetrated through the throughhole, respectively, conductive bearings are formed in the inner side of the metal body, and other throughholes are formed through which the third and fourth slide bars are penetrated, wherein an insulation sleeve is penetrated and inserted through one of the throughholes through which the third and fourth slide bars are penetrated, and the electric power of the first and second slide bars is applied to only one of the third and fourth slide bars having no insulation sleeve via the conductive bearings.

9. The movable lighting apparatus according to claim 7, wherein the conductive bearings are plate-shaped springs.

10. A movable lighting apparatus comprising:

a pair of fixed rails forming a first axis having bar-shaped terminals to which negative and positive electric power voltages are applied in both sides of a fixed rail frame, respectively, in which the lower portion of the frame is opened, and which are disposed on the ceiling in parallel with each other;

at least one movable rail forming a second axis having bar-shaped terminals in both sides of a movable rail frame and which is cross-linked perpendicularly with the fixed rails which are combined with both ends of the movable rail, respectively;

a movable unit which moves in the fixed rails and the movable rail independently, respectively, contacts the terminals and is integrally connected with the movable rail only in the fixed rails; and an illumination/connection power connection member which is extended downwards from the movable unit and is electrified by electric cable wires.

11. The movable lighting apparatus according to claim 10, wherein the movable rail is electrified between the fixed rails and by the electric cable wires from the illumination/connection power connection member to the terminals.

12. The movable lighting apparatus according to claim 10, wherein the a second movable unit including the illumination/connection power connection member slidably moves along the movable rail.

13. The movable lighting apparatus according to claim 10, wherein the first movable unit in the fixed rails is formed by extending the fixing frames which are detached from the movable rail.

14. The movable lighting apparatus according to claim 10, wherein the movable unit moves by means of wheels.

15. The movable lighting apparatus according to claim 10, wherein the illumination/connection power connection member is a socket.

16. The movable lighting apparatus according to claim 10, wherein the illumination/connection power connection member is a receptacle for plug connection.

17. The movable lighting apparatus according to claim 10, wherein the movable unit is electrified by contact of the terminals through a main power connector.

18. The movable lighting apparatus according to claim 17, wherein the main power connector comprises a housing; an elastic member which is disposed at one side of the housing, and a roller idling at the other side of the housing.

19. The movable lighting apparatus according to claim 18, wherein the housing comprises a guide pin which is formed at the rear end of the housing, for guiding the location of the elastic member.

20. The movable lighting apparatus according to claim 18, wherein an elongate hole is formed at both sides of the housing in the illumination/connection power connection member, which is locked and unlocked by means of inclined pieces formed at both sides of the accommodation grooves in the movable unit.

21. The movable lighting apparatus according to claim 18, wherein the illumination/connection power connection member slidably contacts the terminals by contact pieces fixed to the other side of the housing which is elastically supported.

22. The movable lighting apparatus according to claim 10, wherein the fixed rails comprises is a power plug, connection terminals connected with the terminals which are connected with the power plug, and a cover which is inserted into an end of the frame.

23. The movable lighting apparatus according to claim 4, wherein the illumination/connection power connector comprises: a body at both upper sides of which a catching portion is formed and whose lower portion is connected in a plate form; conductive contact plates formed in the inner sides of both the catching portions, respectively; a suspended member having built-up power lines withdrawn from the contact plate; and a socket adhered to the suspended member.

24. The movable lighting apparatus according to claim 8, wherein the conductive bearings are plate-shaped springs.

25. The movable lighting apparatus according to claim 12, wherein the movable unit moves by means of wheels.

* * * * *